United States Patent [19]

Hurner

[11] Patent Number: 4,686,950

[45] Date of Patent: Aug. 18, 1987

[54] ENGINE IDLE ADVANCE

[76] Inventor: Erwin E. Hurner, 320 Eighth St. West, West Fargo, N. Dak. 58078

[21] Appl. No.: 887,264

[22] Filed: Jul. 21, 1986

[51] Int. Cl.[4] ..... F02D 11/10

[52] U.S. Cl. ..... 123/339; 180/170; 123/340

[58] Field of Search ..... 123/339, 340; 180/170, 180/178

[56] References Cited

U.S. PATENT DOCUMENTS

| | | | |
|---|---|---|---|
| 3,156,333 | 11/1964 | Barnes | 123/339 |
| 3,195,525 | 7/1965 | Beck | 123/339 |
| 3,229,792 | 1/1966 | Hock | 123/339 |
| 4,205,639 | 6/1980 | Kawase | 123/339 |
| 4,367,709 | 1/1983 | Codrington | 123/339 |
| 4,401,075 | 8/1983 | O'Keefe | 123/339 |

*Primary Examiner*—Ronald B. Cox

*Attorney, Agent, or Firm*—Bailey & Hardaway

[57] ABSTRACT

An apparatus which reduces accumulation of combustion products in internal combustion engines by periodically increasing the revolutions during periods of idle.

2 Claims, 1 Drawing Figure

ENGINE IDLE ADVANCE

BACKGROUND OF THE INVENTION

This invention relates generally to the art of internal combustion engines and more particularly to an apparatus for preventing accumulation of products of incomplete combustion during periods of extended idle.

In the field of automotive vehicles, and particularly diesel operated trucking vehicles, it is known that products of incomplete combustion which are not removed via the exhaust of such engines accumulate within combustion cylinder walls. This leads to damage to rings and overall engine damage. The problem is particularly severe in diesel engines which can result in partial plugging of injectors causing irregular spray patterns and partial firing. Such accumulations will eventually result in high oil consumption, excessive smoke, loss of power, and reduced fuel efficiency.

In the utilization of over-the-road trucking vehicles, particularly diesel vehicles, it is common practice in cold weather to maintain such vehicles at idle during periods of non-usage. Such idle periods may be for periods of approximately one hour during which time the driver operator has meals or may be for periods of eight to ten hours while the driver obtains lodging. Such extended periods of idle are necessary in cold weather to assure that the vehicle will continue to be operable during such cold weather. The problems discussed above regarding accumulation of combustion products are particularly severe during periods of extended idle.

Prior to the invention herein disclosed there has been no attempt to confront this problem.

SUMMARY OF THE INVENTION

It is thus an object of this invention to provide an apparatus to reduce accumulation of products of incomplete combustion in internal combustion engines.

It is a further object of this invention to provide such an apparatus which is operable to reduce accumulation of products of incomplete combustion during periods of extended engine idling.

These, as well as other objects, are accomplished by an improvement to an internal combustion engine which comprises an air actuated cylinder communicating through a linkage to the throttle of such engines to periodically through the actuation of said cylinder open said throttle to increase the flow of fuel to said engine and thus increase the level of engine operation and force increased amounts of incomplete combustion products to exhaust from the internal combustion engine.

BRIEF DESCRIPTION OF THE DRAWING

The single FIGURE of drawing schematically illustrates the apparatus in accordance with this invention.

DETAILED DESCRIPTION

Figure 1:
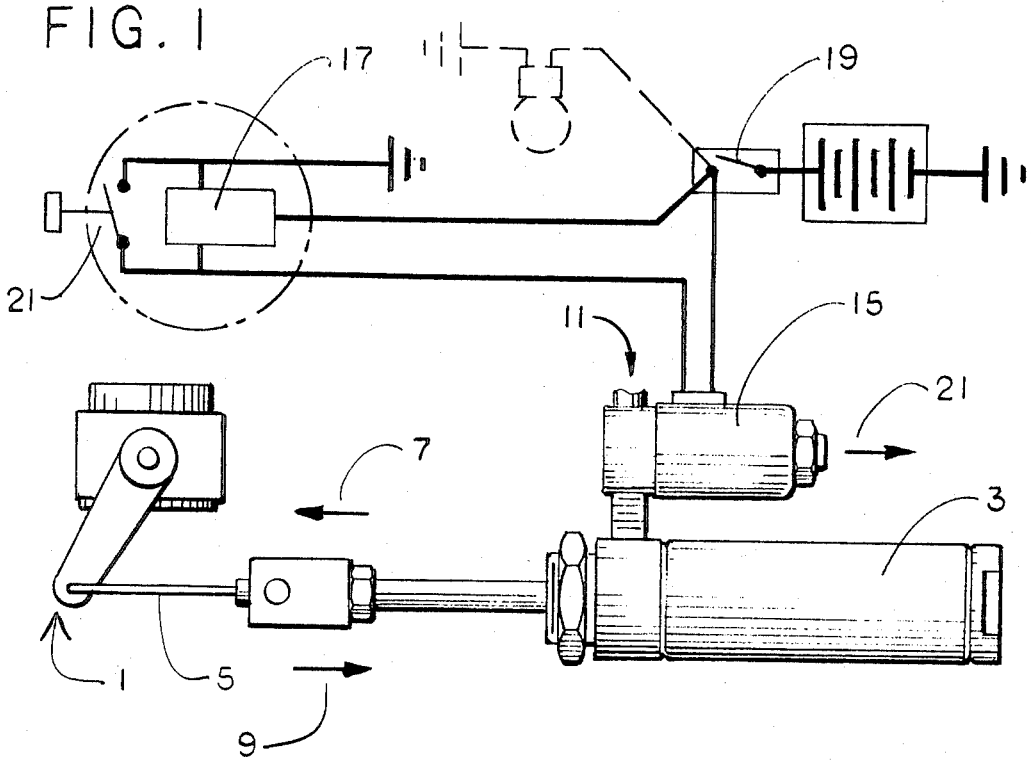

In accordance with this invention it has been found that an apparatus may be utilized to periodically increase the level of engine operation during periods of idle. Particularly the apparatus of this invention periodically advances and opens the throttle of an internal combustion engine to increase the revolutions per minute thereof and thus force increased amounts of incomplete combustion products to exhaust from the engine. Various other advantages and features will become apparent from the following description given with reference to the FIGURE of drawing.

The single FIGURE of drawing illustrates the improvement for an internal combustion engine in accordance with this invention wherein the throttle for such engine is illustrated at 1. The improvement comprises an air actuated cylinder 3 in communication with throttle 1 through linkage 5. When air actuated cylinder 3 is in its unactuated state, throttle 1 is in the idle state as generally indicated by arrow 7. However, upon actuation of cylinder 3, linkage 5 moves in the direction of arrow 9 to increase the operating revolutions per minute of the internal combustion engine.

The air actuated cylinder is in communication with a source of pressurized air 11 such as a reservoir of pressurized air as is utilized in over-the-road trucking diesel vehicles. The actuation of air actuated cylinder 3 is controlled by solenoid 15 which controls the flow of air into and out of cylinder 3.

Solenoid 15 in turn is controlled by control module 17 which determines the period of actuation and non-actuation of air actuated cylinder 3.

It is mandatory that the apparatus of this invention be operable only during periods of engine idle. During periods of idle, the actuated cylinder is operable every 15 minutes for a period of 7 seconds to increase the operating revolutions per minute to full governed throttle. It has been found that such engine operation tends to remove excess incomplete combustion products prior to the advent of the deleterious results outlined above.

To this end control module 17 is in association with the parking brake of the vehicle and is activated by engagement of such brake. The control module is preferably in electrical communication with the circuit of emergency lighting system 19 upon engagement of a parking brake. As a check for the overall apparatus, an additional wiring circuit is associated with a test switch 2 which is operated from within the cab of the vehicle.

The apparatus of this invention is operable upon engagement of the parking brake or spring brake of a truck vehicle. The engagement of the brake of the vehicle thus actuates and provides electrical communication with the apparatus of this invention through 19. Upon such electrical engagement control module 22 immediately begins to measure a 15 minute period of idle. At the conclusion of the 15 minute period control module 22 actuates solenoid 15 which permits air actuated cylinder to communicate with a source of pressurized air 11 and thus moves linkage 5 in the direction of arrow 9 to fully open throttle 1. Throttle 1 remains open for a period of 7 seconds at which time control module 22 deactivates solenoid 15 permitting pressurized air within cylinder 3 to exit through exit port 21 thus causing linkage 5 to move in direction of arrow 7 and again resume a period of normal idling speed. The process repeats itself until the parking brake is released or the engine is deactivated.

It has been found that the apparatus of this invention when utilized as described above results in significantly increased engine life, reduced accumulation of incomplete combustion products, and the deleterious effects associated therewith.

As many variations will become apparent to those of skill in the art from a reading of the above specification which is exemplary in nature, such variations are embodied within the spirit and scope of this invention as measured by the following appended claims.

What is claimed is:

1. In an internal combustion engine having a throttle to control the fuel flow to said engine, said engine having a predetermined idle speed, the improvement comprising:

an air actuated cylinder;

a linkage between said cylinder and said throttle whereby actuation of said air actuated cylinder moves said linkage and opens said throttle to increase the flow of fuel to said engine and increase the revolutions per minute thereof;

a solenoid valve for controlling the flow of air into and out of said cylinder; and a control module for controlling said solenoid valve including a control module for causing periodic actuation and non-actuation of said air actuated cylinder whereby said internal combustion engine is periodically operated at a speed higher than said pretermined idle speed during periods of idle to reduce the accumulation of combustion products in said internal combustion engine; and said internal combustion engine being operatively associated with a vehicle having parking brake means whereby actuation of said parking brake means actuates said control module.

2. The improvement according to claim 1 further including a test circuit to actuate said control module.

* * * * *